US005427535A

United States Patent [19]

Sinclair

[11] Patent Number: 5,427,535

[45] Date of Patent: Jun. 27, 1995

[54] RESILIENT ELECTRICALLY CONDUCTIVE TERMINAL ASSEMBLIES

[75] Inventor: William Y. Sinclair, Frenchtown, N.J.

[73] Assignee: Aries Electronics, Inc., Frenchtown, N.J.

[21] Appl. No.: 126,783

[22] Filed: Sep. 24, 1993

[51] Int. Cl.[6] ..... H01R 9/09

[52] U.S. Cl. ..... 439/66; 439/67; 439/72

[58] Field of Search ..... 439/59, 62, 65, 66, 439/88–91, 736, 71, 72, 67

[56] References Cited

U.S. PATENT DOCUMENTS

| | | | |
|---|---|---|---|
| 4,330,165 | 5/1982 | Sado | 439/66 |
| 4,593,961 | 6/1986 | Cosmo | 439/66 |
| 4,820,376 | 4/1989 | Lambert et al. | 439/66 |
| 5,309,324 | 5/1994 | Hernandez et al. | 439/66 |

*Primary Examiner*—David L. Pirlot

*Attorney, Agent, or Firm*—Anthony J. Casella; Gerald E. Hespos

[57] ABSTRACT

An electrical connector assembly is provided for releasable electrical connection of a high density memory module to a circuit board. An electrical connector assembly includes a base having an array of apertures extending therethrough for registration with both the contact pads of the memory module and of the circuit board. Resilient terminal assemblies are mounted in each of the apertures of the base. Each terminal assembly includes an electrically conductive terminal exposed at both ends of the terminal assembly and with a connection extending therebetween. The contacts and the connection of the terminal may be stamped and formed from a unitary strip of conductive metal. The terminal is insert molded in elastomeric material dimensioned to be frictionally retained in a corresponding aperture of the base. The dimensions of the elastomeric plug and the apertures are selected to control the amount of compression that is permissible as the electrical connector is engaged between the memory module and the circuit board.

18 Claims, 5 Drawing Sheets

RESILIENT ELECTRICALLY CONDUCTIVE TERMINAL ASSEMBLIES

BACKGROUND OF THE INVENTION

1. Field Of the Invention

The subject invention relates to resilient electrically conductive terminal assemblies for use in high density circuit applications, such as connecting high density memory modules to a circuit board.

2. Description Of the Prior Art

Memory modules include a generally planar rectangular ceramic body with an integrated circuit chip centrally therein. Electrically conductive leads extended from the chip to the periphery of the ceramic body. Until recently, memory modules were substantially as shown in FIG. 1. More particularly, the prior art memory module 10 of FIG. 1 has electrically conductive pins 12 extending outwardly from the ceramic body. The pins 12 are generally L-shaped, and include a first leg projecting from a side edge of the ceramic body generally parallel to the plane of the circuit board 14, and a second leg projecting downwardly approximately orthogonally to the rectangular chip. The pins 12 project through apertures 16 in the circuit board and are soldered to electrically conductive paths printed or otherwise disposed on the circuit board 14. The soldered connections between the pins 16 and the electrically conductive paths on the circuit board 14 are visible and accessible. Thus, the prior art assembly shown in FIG. 1 enables the quality of the soldered connections to be optically assessed.

The prior art memory module typically is the most expensive element on the board. It is not uncommon for a prior art memory module to cost between $50.00 and $100.00. The entire board, prior to mounting the memory module thereto also might cost $50.00–$100.00. The completed board invariably is tested prior to final installation into a computer or other piece of electronic equipment. If possible, any observed defect would be corrected, rather than discarding the entire board. For example, if a memory module was found the be defective, the accessible soldered connections might be desoldered. The defective memory module would then be discarded and a new memory module would be soldered to the board. If the board was found to be defective, the memory module could be desoldered and used on another board.

Memory modules have steadily become more complex and sophisticated without corresponding increases in size. Initially, the greater complexity led to more leads extending from the side edges and a corresponding increase in the number of apertures in the circuit board. However, the increase in the number of apertures was found to cause local weaknesses in the circuit board. In response to these problems surface mount memory modules were developed for mounting directly to the surface of a circuit board without a dense array of through holes. With reference to FIG. 2, the prior art surface mount memory module **10*a* has either short leads 12*a* projecting from side edges or contact pads along side edges that are soldered to contact pads 16*a* on the surface of the circuit board 14*a*. The prior art surface mount memory module 10*a* enables somewhat greater circuit densities without weakening the board 14*a*. The prior art surface mount memory module 10*a*** still enables optical inspection of soldered connections and permits desoldering when necessary.

Memory modules have continued to increase in complexity without corresponding increases in size. The greater circuit densities enabled by the more complicated memory modules could not readily be accommodated along the peripheral edges of the memory module. Furthermore, connections along peripheral edges of the memory module require a bigger circuit "footprint" which offsets the miniaturization being achieved within the memory module. As a result, memory modules were developed with conductive paths leading to the bottom surface for mating with a corresponding array of conductive paths on the circuit board. An example of such a prior art high density memory module is illustrated schematically in FIGS. 3 and 4. In particular, the memory module **10*b* includes a plurality of conductive dots 12*b* on the bottom face thereof. The circuit board 14*b* includes a corresponding array of conductive pads 16*b*. Current technology permits the dots 12*b* and pads 16*b* to be disposed at center-to-center spacings, as indicated by dimension "a" in FIG. 3 of approximately 0.050 inch, and further miniaturization is possible. The prior art memory module 10*b* is accurately positioned such that the conductive dots 12*b* contact the conductive pads 16*b*. The circuit board is then subjected to wave soldering, or other known soldering techniques, to permanently connect the memory module 10*b* to the circuit board 14*b* as shown in FIG. 4. However, in contrast to the prior art embodiments depicted in FIGS. 1 and 2, the soldered connections in FIG. 4 are not visible and cannot be optically checked. Furthermore, the soldered connections in FIG. 4 are not accessible and hence the memory module 10*b* cannot readily be removed if a defect is subsequently observed in either the memory module 10*b* or the circuit board 14*b*. The more complex and sophisticated memory modules shown in FIGS. 3 and 4 often are significantly more costly than the prior art memory modules depicted in FIGS. 1 and 2. It is not uncommon for a memory module to cost more than $100.00, and some cost as much as $500.00. Additionally, the circuit boards for these sophisticated memory modules also are more complex, and hence more costly than their simpler predecessors. The difficulties of desoldering the inexcessible connections shown in FIG. 4** may force a computer manufacturer to discard both a memory module and a circuit board. Often either the discarded memory module or the discarded board will be perfectly functional. In some instances both the discarded memory module and the discarded board will be functional, and the defect will merely exist in a soldered connection between the two. The component manufacture would prefer not to discard a perfectly good memory module costing several hundred dollars, nor a good circuit board costing in excess of $100.00.

In view of these problems, the prior art has developed a high density memory module socket assembly as shown schematically in FIGS. 5 and 6. The prior art memory module socket assembly uses the circuit board **14*b* and the memory module 10*b* described and illustrated above. However, the prior art socket assembly further includes a base 18 having an array of apertures 20 extending therethrough and registered with the contact pads 16*b* on the circuit board 14*b*. The apertures 20 are filled with a jumbled array of very thin conductive wire 22 resembling a small steel wool pad. A jumbled wire array 22 is urged into each aperture 20, and is dimensioned to extend beyond the opposed surfaces of the prior art base 18. Thus, the wire 22 in the aperture 20 will engage a conductive pad 16*b* on the circuit board 14*b* and will engage a corresponding conductive pad 12*b* on the memory module 10*b* to provide electrical connection therebetween. Solder is entirely avoided, and mechanical means are used to hold the memory module 10*b* and the prior art base 18 in proper registration on the circuit board 14*b*. The memory module 10*b* can be removed and replaced or repositioned for any reason, such as an observed defect in either the memory module 10*b* or the circuit board 14*b***.

The connector assembly shown in FIGS. 5 and 6 overcome several of the disadvantages described with respect to the soldered connection depicted in FIGS. 3 and 4. However, the prior art connector assembly shown in FIGS. 5 and 6 also has drawbacks. One such drawback is cost. Prior art connectors, as shown in FIGS. 5 and 6, often cost between nine cents and fifteen cents per connection. Thus, a memory module with 500 conductive pads would have a connector costing $45.00–$75.00. Second, it is difficult to ensure that the jumbled array of wire 22 will exert the specified pressures against both the walls of the aperture 20 through the base 18 and on the conductive pads **12*b* and 16*b* on the memory module and board respectively. The entire jumbled array of wire 22 will fall out of the aperture 20 if the engagement forces are too low. Similarly, poor electrical connection will be achieved if the contact forces between the jumbled array of wire and the memory module for the board are too low. Furthermore, the jumbled array of wire 22 is not well suited to making plural make and break connections. Thus, if a defect in the memory module is observed or if it is desired to merely change to a different memory module, the jumbled array of wire 22** may not resiliently return a sufficient amount to make a good second connection.

In view of the above, it is an object of the subject invention to provide a connector for a high density memory module.

It is another object of the subject invention to provide a memory module connector that enables repeated connection and disconnection of high density memory modules therefrom.

It is a further object of the subject invention to provide an electrically conducted terminal assembly for connecting the contact pad of a memory module to the contact pad of a circuit board.

SUMMARY OF THE INVENTION

The subject invention is directed to an electrical connector assembly and to resilient electrically conductive terminals for use therein. The electrical connector assembly of the subject invention includes a base having a plurality of apertures extending therethrough for registration with conductive pads on a circuit board and conductive pads on a memory module. The base may further include means for mounting the base to the circuit board and means for receiving a memory module thereon. Additionally, the base may include means for receiving a cover for holding the memory module in secure electrical contact with the conductive pads on the circuit board as explained herein. The mounting means for securing the base and/or the cover in fixed relationship to the circuit board may merely include bolts or screws passing through the base and/or the cover and connected to the circuit board. The bolts may be configured to achieve secure engagement or disengagement in response to a quarter turn.

The resilient terminal assemblies of the subject invention comprise a board contact, a module contact and an elongate flexible connector extending therebetween. The board contact and the module contact may have surfaces coated or otherwise treated to have miniature spike-like surface features and corresponding multiple contact points. For example, the board contact surface and the module contact surface may be provided with a dendritic contact interface similar to the dendritic interface available through IBM-Endicott. The connector may define a flexible braided wire electrically connected to the contacts by soldering, crimping or the like. However, in a preferred embodiment, the contacts and the connector are unitarily stamped and formed from a strip of conductive metal. The connector of the resilient terminal assembly is configured to be selectively contracted and/or expanded and to undergo plural cycles of resilient compression and expansion. For example, the connector of the resilient terminal assembly may be formed into a generally sinusoidal wave shape or a coiled configuration.

The resilient terminal assembly of the subject invention further comprises an elastomeric plug surrounding the connector and portions of the contacts. The plug and the terminal may be joined by insert molding, such that the plug defines a unitary matrix of elastomeric material surrounding the connector of the terminal assembly and portions of the contacts. The plug of the terminal assembly defines a cross-sectional configuration which enables the terminal assembly to be frictionally retained in an aperture of the base without gravitationally falling from the aperture. The plug also is cross-sectionally dimensioned to permit a controlled axial contraction of the plug in the aperture as opposed contacts are urged toward one another. Thus, for example, the plug may include an annular bead extending therearound and defining a diameter sufficient for frictional engagement of the plug in an aperture. However, portions of the plug on either side of the annular bead may define smaller diameters which permit transverse expansion of the plug as the opposed ends of the terminal assembly are contracted inwardly and toward one another.

The terminal assembly defines a length as measured between the oppositely facing contacts which is greater than the thickness of the base. Thus, the terminal assemblies can be frictionally mounted in apertures of the base with the oppositely facing contacts projecting beyond opposed faces of the base. With these relative dimensions, the terminal assembly can be compressed by both the conductive pads on the circuit board and the conductive pads on the memory module, and the terminal assembly will exert selected quantifiable contact forces against the circuit board and the memory module. The magnitude of the contact forces and the amount of deformation can be controlled precisely by carefully selecting the cross-sectional dimensions of the elastomeric plug and the aperture in the base. In this regard, the aperture through the base can be dimensioned to control the cross-sectional or transverse expansion of the plug that necessarily occurs as the plug is being axially compressed. The amount of axial contraction and hence the contact forces also can be controlled by standoffs molded into the base. The standoffs can positively control the amount of compression permitted in the terminal assembly.

The terminal assembly provides several distinct advantages over the prior art. First, the frictional forces between the plug of the terminal assembly and the walls of the aperture through the base can be easily controlled to prevent the terminal assemblies from falling out of the holes in the base. Similarly, the relative dimensions of the plug and the apertures through the base can be selected to achieve narrowly specified contact forces. Contact forces also can be controlled by the selection of the elastomer to be incorporated into the plug. Still further, the terminal assemblies are well suited to automated insertion into the apertures, and hence enable significant cost efficiencies.

DETAILED DESCRIPTION OF THE PREFERRED EMBODIMENT

Figure 1:
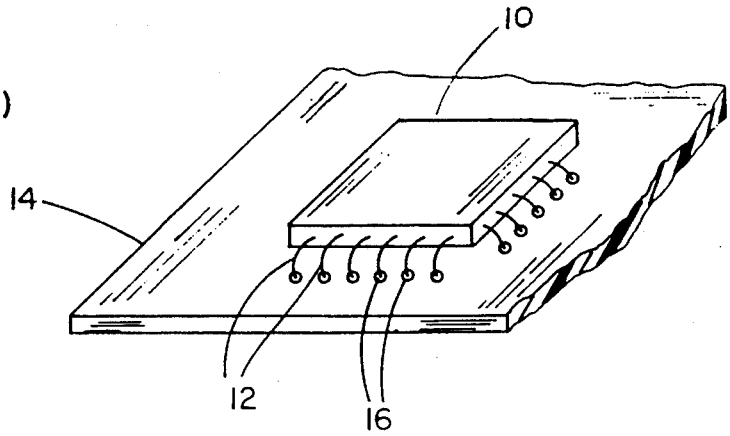
FIG. 1 (PRIOR ART)
FIG. 1 is a perspective view of a first prior art memory module and circuit board assembly.
Figure 2:
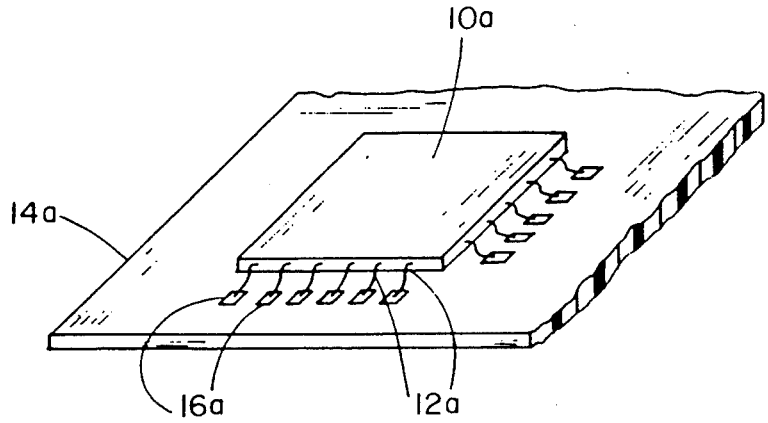
FIG. 2 (PRIOR ART)
FIG. 2 is a perspective view of a second prior art memory module and circuit board assembly.
Figure 3:
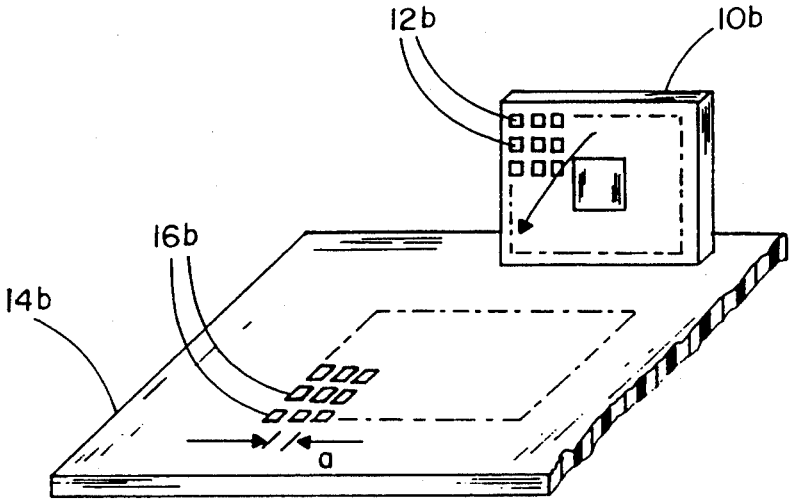
FIG. 3 (PRIOR ART)
FIG. 3 is an exploded perspective view of a third prior art memory module and circuit board assembly.
Figure 4:
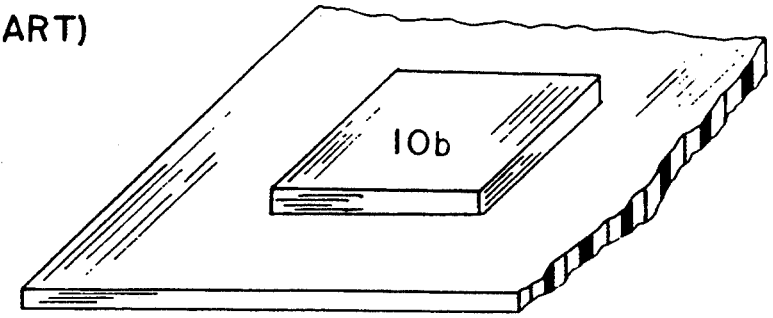
FIG.4 (PRIOR ART)
FIG. 4 is a perspective view of the assembled prior art memory module and circuit board assembly.
Figure 5:
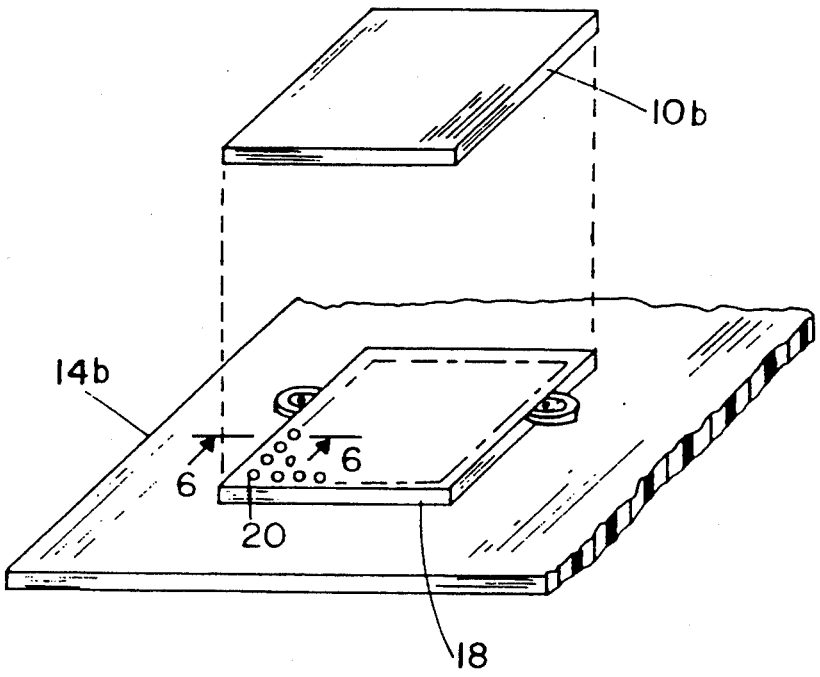
FIG.5 (PRIOR ART)
FIG. 5 is an exploded perspective view of a prior art memory module, connector assembly and circuit board in accordance with the subject invention.
Figure 6:
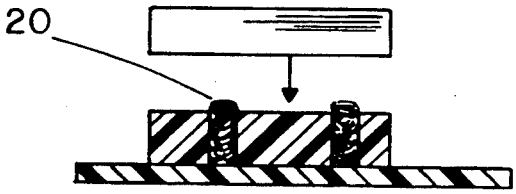
FIG.6 (PRIOR ART)
FIG. 6 is a cross-sectional view taken along line 6—6 in FIG. 5.
Figure 7:
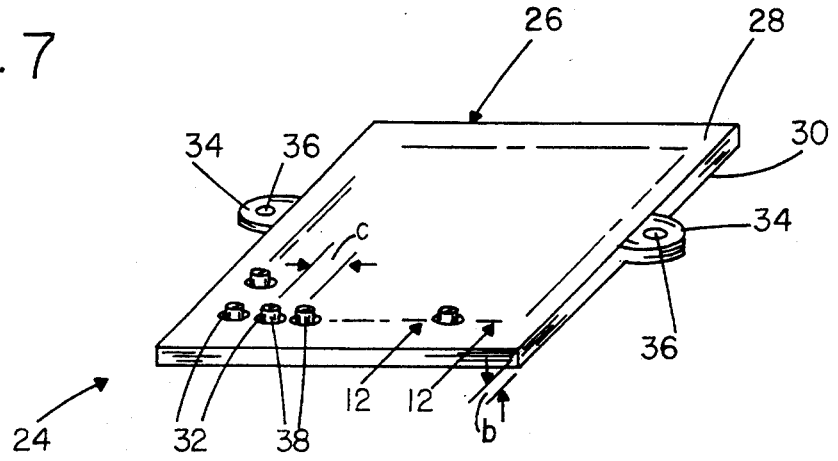
FIG. 7 is a perspective view of a connector assembly in accordance with the subject invention.

The connector assembly in accordance with the subject invention is identified generally by the numeral 24 in FIGS. 7 and 12–14. The connector assembly 24 includes a base 26 which may be unitarily molded from a thermoplastic material. The base 26 is of substantially rectangular planar configuration with opposed top and bottom faces 28 and 30 respectively which define a thickness "b" of approximately 0.062 inch. The base 26 is provided with an array of apertures 32 drilled therethrough or molded therein to extend entirely from the top face 28 to the bottom face 30 thereof. The apertures 32 are at center-to-center spacings "c" corresponding to the spacing of conductive pads on a circuit board and on a memory module with which the connector 24 is employed. For example, the apertures 32 may be disposed at center-to-center spacings "c" approximately equal to 0.050 inch. The base 26 further includes mounting flanges 34 projecting therefrom and having apertures 36 for receiving bolts to enable secure mounting of the base 26 to a circuit board as explained further herein.

Figure 8:
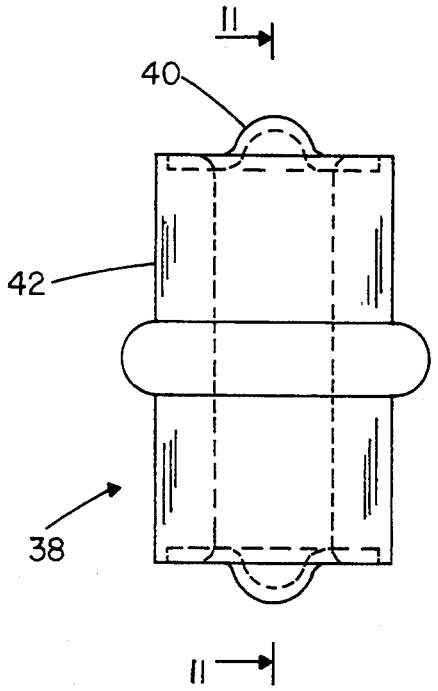
FIG. 8 is a side elevational view of a resilient electrically conductive terminal assembly used in the connector assembly of FIG. 7.
Figure 9:
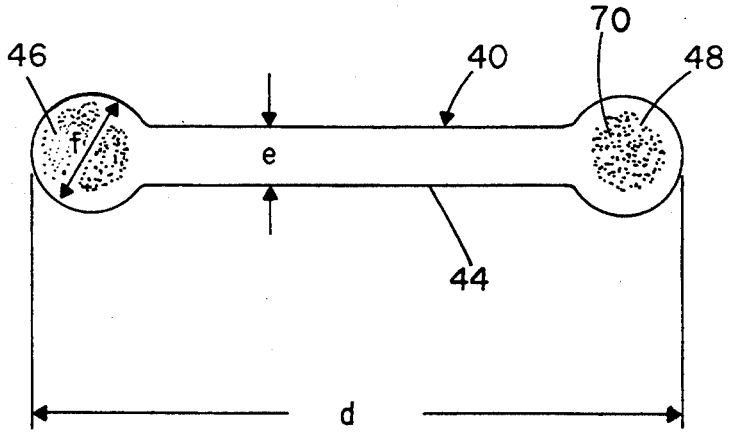
FIG. 9 is a top plan view of a stamped blank for the conductive portions of the terminal assembly.
Figure 10:
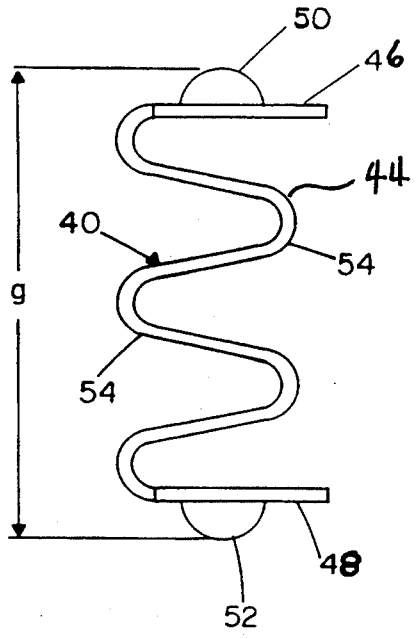
FIG. 10 is a side elevational view of the blank formed for use in the connector assembly.
Figure 11:
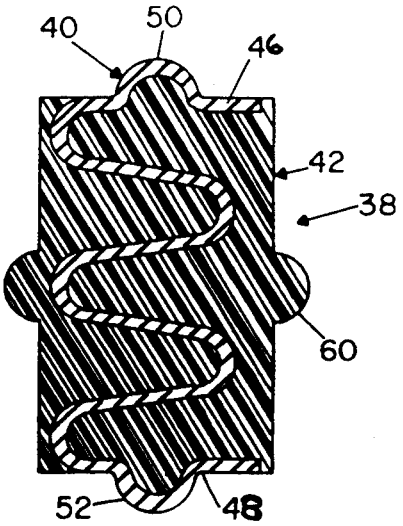
FIG. 11 is a cross-sectional view taken along line 11—11 in FIG. 8.

The connector assembly 24 further includes resilient electrically conductive terminal assemblies 38 mounted respectively in the apertures 32. Each terminal assembly 38 includes a terminal 40 insert molded into a generally cylindrical elastomeric plug 42. The terminal 40, as shown in FIGS. 8–10, is stamped from a unitary strip of beryllium copper alloy having a thickness of approximately 0.003 inch. The terminal 40 is initially stamped to define an elongate planar blank having a length "d" of approximately 0.275 inch, as illustrated in FIG. 9. The blank of the terminal 40 includes an elongate connecting portion 44 defining a width "e" of approximately 0.025 inch. First and second generally round contacts 46 and 48 are disposed at opposite ends of the connecting portion 44. The contacts 46 and 48 define diameters "f" of approximately 0.048 inch. Additionally, the contacts 46 and 48 may be gold plated on one side. The contacts 46 and 48 may further be provided with surface treatments to define miniature spike-like structures 70 with multiple contact points thereon. These features may be defined by a dendritic contact interface similar to that available through IBM-Endicott.

The blank of the terminal 40 is initially formed to include contact dimples 50 and 52 on the contacts 46 and 48 respectively. The elongate connecting portion 44 then is formed to define a plurality of resiliently deflectable generally sinusoidal bends 54, with the contacts 46 and 48 being substantially parallel. Sides of the contacts 46 and 48 opposite the dimples 50 and 52 define pressure bearing surfaces that will compress an adjacent elastomer, as explained herein. In this initially formed condition, the terminal 40 defines a height "g" of approximately 0.105 inch.

The terminal 40 and the plug 42 are insert molded such that the elastomer of the plug 42 defines a unitary matrix surrounding and engaging the elongate connecting portion 44 of the terminal 40. The insert molding is carried out such that the contact dimples 50 and 52 are exposed for making electrical contact with the circuit board and the memory module respectively. However, the opposed pressure bearing surfaces are embedded in the elastomer. The molding cavity in which the terminal assembly 38 is formed is dimensioned to slightly compress the formed terminal 40 to define an overall axial length "h". As a result, the formed terminal 40 will be under a slight preload. The overall axial length "h" of the formed terminal will be a function of the thickness of the base 26 and the amount of resilient deformation desired for the particular circuit board and memory module. In the illustrated example, the base 26 defines a thickness of approximately 0.062 inch, and the height "h" of the terminal assembly 38 equals approximately 0.100 inch.

Figure 12:
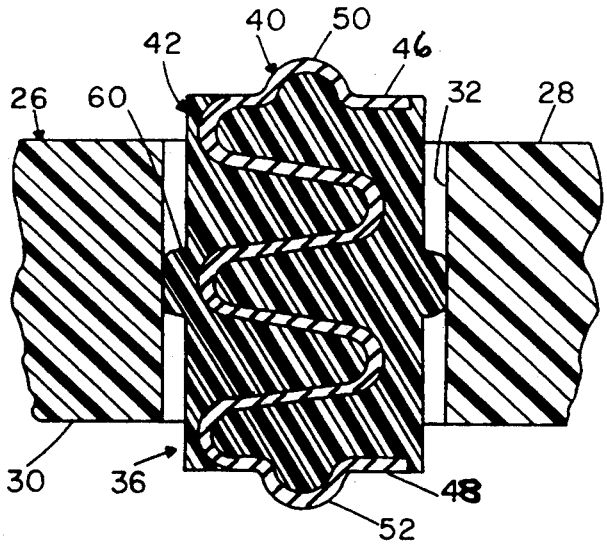
FIG. 12 is a cross-sectional view taken along line 12—12 in FIG. 7.
Figure 13:
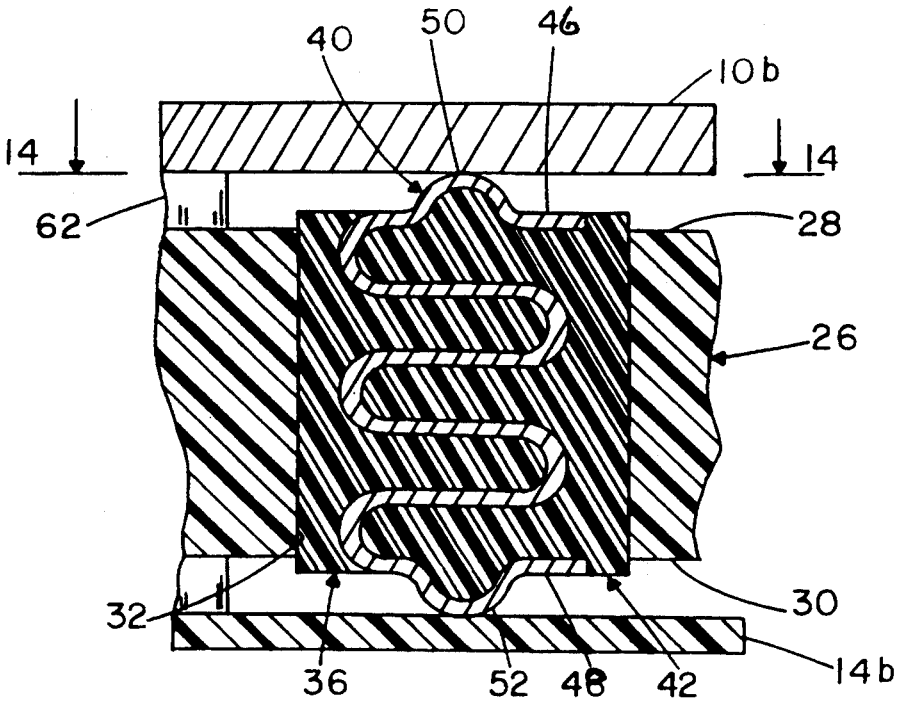
FIG. 13 is a cross-sectional view similar to FIG. 12 but showing the connector assembly in electrical contact with a circuit board and a memory module.
Figure 14:
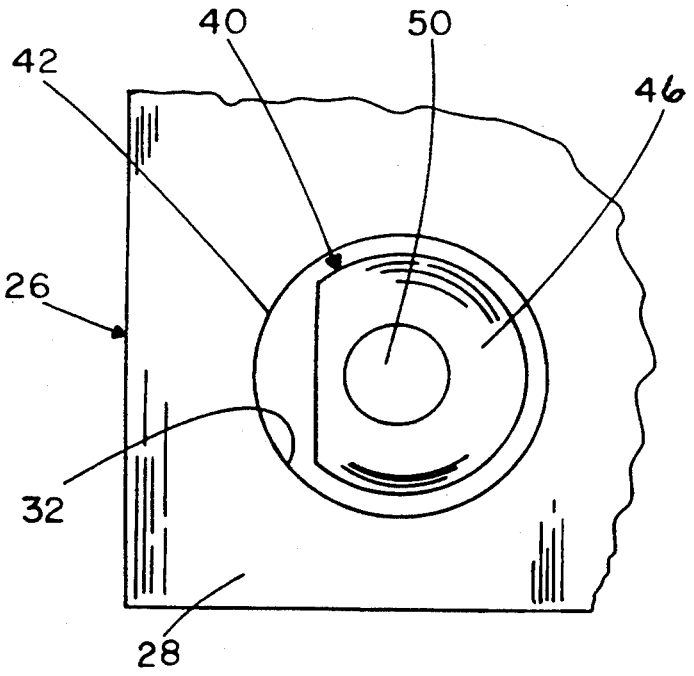
FIG. 14 is a cross-sectional view taken alongline 14—14 in FIG. 13.

The diametric dimensions of the plug 42 are a function of the diameter of each aperture 32 in the base 26 and a function of the maximum amount of compression desired for the terminal assembly 38. In the illustrated embodiment, each aperture 32 in the base 26 defines a diameter "i" of approximately 0.060 inch. In this embodiment, the plug 42 defines a diameter "j" of approximately 0.050 inch along a major portion of its length. However, the plug 42 includes an annular rib 60 extending thereabout at a central position between the ends 56 and 58 of the plug 42. The rib 60 defines an outside diameter "k" which is approximately equal to 0.065 inch, or slightly greater than the diameter of the aperture 32. Thus, as shown in FIG. 12, the rib 60 will require deformation for insertion of the terminal assembly 38 into the aperture 32. As a result, the resiliently deformed annular rib 60 will exert pressure against portions of the base 26 defining the aperture 32 for preventing unintended separation or removal of the terminal assembly 38. Also with reference to FIG. 12, portions of the plug 42 on either side of the rib 60 will be disposed in spaced relationship to the walls of the aperture 32. The radial distance between the plug 42 and the walls of the aperture 32 are selected to control the amount of permissible compression of the terminal assembly 38. More particularly, as shown in FIGS. 13 and 14, sufficient compression of the terminal assembly 38 will cause the plug 42 to entirely fill the aperture 32. Upon such complete filling of the aperture 32, the elastomer of the plug 42 will have no room for deformation, and hence further deformation will be substantially prevented. In the embodiment depicted in FIG. 13, this maximum compression defines an overall axial length "l" of approximately 0.085 inch. Thus, the terminal assembly 38 will have undergone a maximum compression of 0.015 inch. In this compressed state, the entire terminal assembly, including the elastomer of the plug 42 and the resiliently deformed terminal 40 will exert forces in opposed axial directions for achieving a high quality contact with both the circuit board and the memory module. The maximum amount of compression can be varied, of course, by altering the relative diametrical dimensions of the aperture 32 and the plug 42. The amount of permissible compression also can be controlled by providing a standoff 62 on the base 26. The standoff 62 will positively control the relative positions of the memory module and circuit board relative to the base 26. For example, standoffs with a height of 0.0075 inch will ensure the compression of 0.015 inch desired for the illustrated embodiment.

The terminal assemblies 38 can be inserted easily into the apertures 32 of the base 26 by vacuum means. In particular, the terminal assemblies may be deposited on the base 26 in an apparatus for applying vibration to the entire base and for applying vacuum through the apertures 32. The vacuum will be of a sufficient strength to urge the respective terminal assemblies 38 into a corresponding aperture 32. The amount of insertion can be positively controlled by stop means in the vacuum apparatus to ensure that each terminal assembly 38 is centered relative to the oppositely disposed surfaces 28 and 30 of the base 26.

The connector 24, with the terminal assemblies 38 mounted in the base 26 is then positioned on the circuit board shown in FIG. 13, and the memory module is positioned on the connector 24. A cover can be threadedly engaged with the mounting tabs 34 to urge the memory module toward the circuit board. The amount of movement of the memory module toward the circuit board is positively controlled by the above described deformation of the plug 42 into the walls defining the respective apertures 32. The amount of movement can further be controlled by the particular connection means which may, for example, be limited to one quarter turn of a threaded screw. In this connected condition, as shown in FIG. 13, the compressed terminal assembly 38 will exert forces in opposed directions to ensure a high quality electrical contact with both the circuit board and the memory module. The entire circuit board then can be tested. If it is determined that either the memory module or the circuit board are defective, the memory module can easily be removed and either discarded or used elsewhere. Additionally, the connector 24 also can be reused with either a new memory module or a new circuit board. The elastomeric plug 42 is capable of more than the twenty cycles preferred by the industry.

While the invention has been described with respect to a preferred embodiment, it is apparent that various changes can be made without departing from the scope of the invention as defined by the appended claims. For example, the terminal may include a wire extending between contacts at the opposed ends of the elastomeric plug.

I claim:

1. A resilient electrically conductive terminal assembly comprising:

first and second spaced apart electrically conductive contacts having contact surfaces facing away from one another;

an elongate deflectable electrically conductive connecting portion extending between and connecting said contact; and a matrix of resiliently compressible elastomeric material surrounding said connecting portion of said terminal assembly, said elastomeric material molded to be of generally cylindrical shape and including generally annular bead extending thereabout for engaging said terminal assembly in an aperture, whereby said terminal is compressible in response to forces exerted on said contact surfaces, and whereby the resiliency of said elastomeric material urges said contact surfaces away from one another and against compressive forces applied thereto.

2. A resilient electrically conductive terminal assembly as in claim 1, wherein said terminal is insert molded into said elastomeric material such that at least said connecting portion of said terminal is surrounded and supported by a unitary matrix of said elastomeric material.

3. A resilient conductive terminal assembly as in claim 1, wherein the contact surfaces facing away from one another have spike-like features for enhancing electrical contact.

4. A resilient conductive terminal assembly as in claim 1, wherein said terminal is unitarily stamped and formed from a beryllium copper alloy.

5. A resilient conductive terminal assembly as in claim 1, wherein said contacts include pressure bearing surfaces facing one another on said terminal, and disposed on sides of said contacts opposite the respective contact surfaces, said elastomeric material being disposed for engaging said pressure bearing surfaces of each said contact.

6. A resilient electrically conductive terminal assembly as in claim 5, wherein said terminal is insert molded into said elastomeric material such that the pressure bearing surface of each said contact is imbedded in said elastomeric material.

7. A resilient electrically conductive terminal assembly as in claim 1, wherein the connecting portion of said terminal is unitary with said contacts.

8. A resilient electrically conductive terminal assembly as in claim 7, wherein said connecting portion is formed to define a plurality of resiliently deflectable bends.

9. An electrical connector assembly for connecting a memory module to a circuit board, said electrical connector assembly comprising:

a base having apertures formed therethrough for registration with contacts on the memory module and on the circuit board, each said aperture defining a selected diameter; and resiliently deflectable electrically conductive terminal assemblies securely mounted respectively in said apertures of said base, each said terminal assembly including an electrically conductive terminal having first and second spaced apart contacts with contact surfaces facing away from one another, said contact surfaces defining a height for said terminal assembly greater than the thickness of said base, said terminal further including a deflectable connecting portion extending between and connecting said contacts, said terminal assembly further comprising an elastomeric material surrounding and supporting at least the connecting portion of said terminal, said elastomeric material being formed to define a generally cylindrical plug, said contact surfaces of said terminal projecting from opposed axial ends of said cylindrical plug, said elastomeric material including at least one region of minor cross-sectional dimension and at least one region of major cross-sectional dimension, said major cross-sectional dimension being greater than the diameter of said aperture in said base, such that portions of said elastomeric material defining the major cross-sectional dimension are frictionally engaged in the aperture of the base.

10. An electrical connector assembly as in claim 9, wherein each said terminal is stamped and formed from a unitary strip of electrically conductive material.

11. An electrical connector assembly as in claim 9, wherein each said contact of said terminal includes a pressure bearing face, the pressure bearing faces being oppositely directed from said contact faces of each said contact and the pressure bearing surface of one said contact facing the pressure bearing surface of the other contact, said pressure bearing faces of said contacts being embedded in the elastomeric material, such that said elastomeric material exerts resilient forces against said pressure bearing surfaces in response to compression of said resiliently deflectable terminal assembly.

12. An electrical connector assembly as in claim 9, wherein said base comprises standoffs spaced from said apertures for controlling the compression of each said terminal assembly.

13. An electrical connector assembly as in claim 9, wherein said major cross-sectional dimension of said elastomeric material is disposed intermediate the contacts of said terminal.

14. An electrical connector assembly as in claim 13, wherein the portions of said elastomeric plug defining the major cross-sectional dimension is a generally annular bead extending around said cylindrical plug and dimensioned to frictionally engage the corresponding aperture in the base.

15. An electrical connector assembly as in claim 14, wherein portions of the cylindrical plug adjacent the annular bead define a diameter less than the diameter of the aperture, the diameters of said cylindrical plug and said aperture being selected such that said elastomeric material substantially fills said aperture before said contact surfaces align with the surfaces of said base.

16. An electrical connector assembly comprising a substantially planar base having opposed first and second surfaces defining a selected thickness therebetween and having at least one generally cylindrical aperture extending therethrough and defining a selected diameter, a resiliently compressible terminal assembly disposed in said aperture, said terminal assembly including a terminal stamped and formed from a unitary strip of conductive material and including opposed first and second substantially parallel contacts, said contacts having contact surfaces facing away from one another and having pressure bearing surfaces facing one another, said terminal further including a deflectable connecting portion extending unitarily between said contacts, said terminal assembly further including an elastomeric plug, said terminal being insert molded into said plug such that said elastomeric material of said plug defines a unitary matrix surrounding and supporting the connecting portion of said terminal and the pressure bearing surfaces of said contacts, said elastomeric material being substantially cylindrical and defining a diameter less than the diameter of said aperture and a length greater than thickness of said base, the generally cylindrical plug including an annular bead extending therearound at a location intermediate the contacts of the terminal assembly, said annular bead defining a diameter greater than the diameter of the aperture in the base, such that said annular bead frictionally retains the terminal assembly in the aperture.

17. A electrical connector assembly as in claim 16, wherein the diameters of the cylindrical plug and the aperture are selected such that compression of the terminal assembly causes the cylindrical plug to fill the aperture before the contact surfaces align with the surfaces of the base.

18. An electrical connector assembly as in claim 16, wherein the base further includes a standoff surrounding the aperture for limiting the amount of compression of the terminal assembly in the aperture.

* * * * *